United States Patent [19]

Uthenwoldt

[11] 3,998,079

[45] Dec. 21, 1976

[54] LOCKING SYSTEM

[75] Inventor: Frederick W. Uthenwoldt, Stamford, Conn.

[73] Assignee: Pitney-Bowes, Inc., Stamford, Conn.

[22] Filed: Aug. 22, 1975

[21] Appl. No.: 606,964

[52] U.S. Cl. ..... 70/292; 70/315

[51] Int. Cl.[2] ..... E05B 37/16

[58] Field of Search ..... 70/286, 287, 288, 291, 70/292, 293, 304, 312, 314, 315, 316, 333

[56] References Cited

UNITED STATES PATENTS

| | | | |
|---|---|---|---|
| 1,416,250 | 5/1922 | Wismiewski | 70/292 |
| 3,664,231 | 5/1972 | Hanson | 20/292 |
| 3,869,885 | 3/1975 | Uthenwoldt | 70/315 |

*Primary Examiner*—Roy D. Frazier
*Assistant Examiner*—Thomas J. Holko
*Attorney, Agent, or Firm*—William D. Soltow, Jr.; Albert W. Scribner; Robert S. Salzman

[57] ABSTRACT

An improvement in a locking system of the type having a series of reference combinations arranged serially upon a tape. A combination entered into said system is compared with the reference combination, and if both combinations are complementary, a lock in the system is released.

The improvement comprises apparatus for preventing the unlocking of the system when all the reference combination setting fingers are depressed, or alternately when all the reference combination setting fingers are in a non-depressed position.

6 Claims, 4 Drawing Figures

LOCKING SYSTEM

This invention pertains to an improved locking system of the type having a reference combination disposed upon a tape, which reference combination is compared with an entered combination to provide a release of a lock.

PRIOR ART

The invention relates to an improvement over the prior locking systems depicted in U.S. Pat. Nos. 3,869,885, issued Mar. 11, 1975; and U.S. Pat. No. 3,664,231, issued May 23, 1972.

As otherwise described herein, the present invention is constructed and operates in like fashion to that shown in these prior patents.

BACKGROUND OF THE INVENTION

Heretofore, it was found possible to release the aforementioned locking systems without obtaining the correct combination under certain circumstances. One possibility was cranking the release knob without depressing any of the combination keys after the combinations on the tape were exhausted. Another possibility was to crank the release knob while depressing all the combination keys after the tape had been severed due to accident or damage. Either of these possibilities allowed the user to effect a release for the system while avoiding the proper unlocking procedure.

The present inventive improvement is designed to eliminate a releasing of the system when the reference combination fingers are either: (a) all depressed, or (b) all non-depressed.

SUMMARY OF THE INVENTION

The invention relates to an improved locking system of the type disclosed in U.S. Pat. Nos. 3,869,885 and 3,664,231.

In these prior systems, a tape containing a series of random type combination is incrementally advanced through the system. At each increment of advancement, the next reference combination on the tape is positioned opposite a plurality of setting fingers. When keys are depressed to enter a complementary combination to that of the reference combination disposed upon the tape, a lock of the system is releasable. In releasing the lock, the tape is incrementally advanced to the next reference combination position.

The present inventive improvement insures that the lock of the system will not be released when a select portion of the fingers are either: (1) all depressed, or (2) all in a non-depressed position.

This is accomplished by means of providing one set of fingers (there are two sets) with extension members. These extension members are disposed between the spring-loaded jaws of a locking bail. One jaw of the bail will be displaced by certain ones of the extensions when one or more of the fingers are depressed. The other jaw of the bail will be displaced by certain ones of the extensions when one or more of the fingers are in a non-depressed position.

When both jaws of the bail are displaced, as when a combination is entered into the system, a locking gate will be free to pass (provided the combination is a correct one).

However, if either of the jaws of the locking bail are not displaced, as when all the fingers are either: (1) depressed, or (2) in a non-depressed condition, then the locking gate will not be free to pass.

An extension on the locking gate, will prevent the gate from moving, because it will not clear the locking bail when either one of the jaws of the bail are in a non-displaced position.

It is an object of this invention to provide an improved locking system of the type having a series of combinations arranged serially upon a tape;

It is another object of the invention to provide apparatus that will prevent the release of the subject locking system when either (a) all the fingers are depressed, or (b) all the fingers are in a non-depressed condition.

These and other objects of this invention will become more apparent and will be better understood with reference to the following detailed description taken in conjunction with the accompanying drawings, in which:

FIG. 1 is a perspective view of the improved locking system of this invention;

FIGS. 2*a*, 2*b* and 2*c* are side views of the locking bail and finger extensions of the invention of FIG. 1; FIGS. 2*a* and 2*b* depicting two locked positions for the bail, and FIG. 2*c* illustrating the bail in an open position.

DETAILED DESCRIPTION

Generally speaking, the invention is an improvement in a combination locking system of the type having a tape containing a plurality of predetermined reference combinations thereon serially disposed. The tape is advanced to a new reference combination position for each unlocking operation performed upon the system. A new combination is entered into the locking system by two sets of keys, for each unlocking operation. The newly entered combination is required to complement the new predetermined reference combination which has been advanced on the tape, in order to unlock a lock of the system.

The improvement comprises depressible fingers for setting the reference combination into the system. The fingers are movable from a first, non-depressed position to a second, depressed position. A locking bail is engageable with a select portion of said fingers and is movable between locking positions and a non-locking position in response to the positioning of the select portion of fingers. The locking bail is in a locking position when all of the select portion of the fingers are in the first, non-depressed position, and also when all of the select portion of the fingers are in the second, depressed position. The locking bail is in a non-locking position when the select portion of fingers are in intermixed positions, via., at least one of the select portion of the fingers is in the second, depressed position.

It is to be noted that the full description of the locking device has been previously given in U.S. Pat. Nos. 3,869,885 and 3,664,231. For the sake of brevity, and to prevent confusion, the present invention will describe only those features, parts, apparatus, and operations that are new, or otherwise modify the previous systems. It is to be understood that all apparatus and functions of this invention are identical with those previously described, unless otherwise stated herein.

Figure 1:
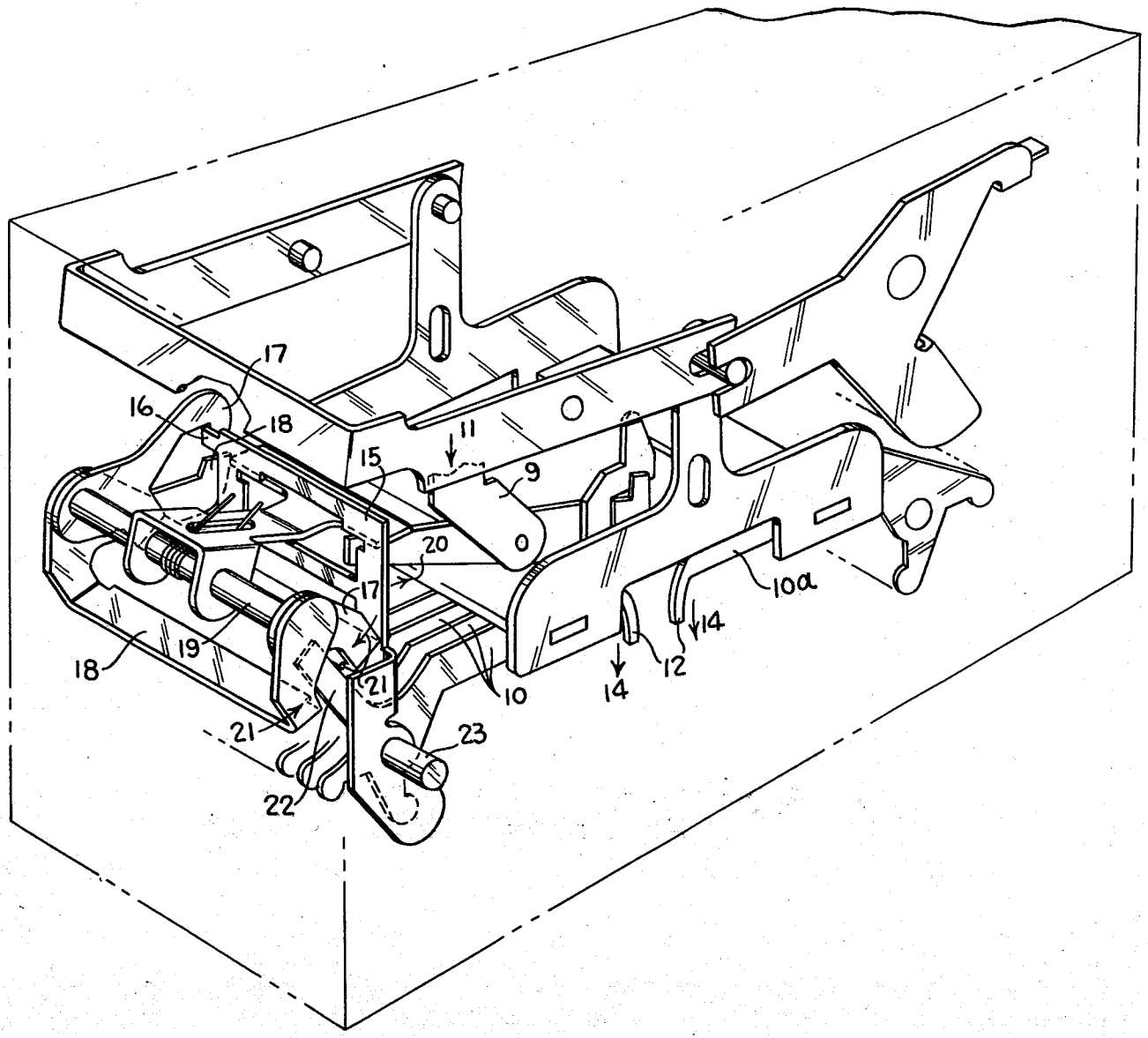
Figure 2A:
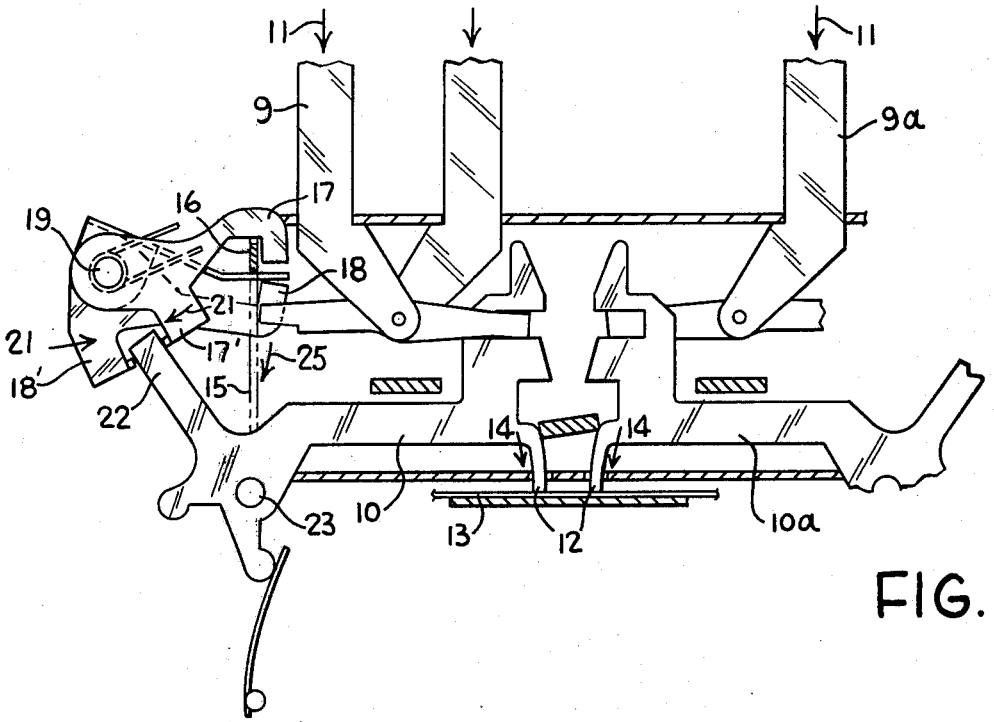

Now referring to FIGS. 1 and 2*a*, a perspective and side views of the improved locking system are shown, respectively. As previously described, there are two sets of keys 9 nd 9*a*, respectively, for setting the entered combination into the locking system. These keys are each influenced and controlled by a corresponding one of the set of fingers 10 and 10*a*, respectively. When the complementary keys 9 and 9*a* are depressed as shown by arrow 11 to match the tips 12 of the fingers 10 and 10*a* which have been spring biased or depressed (arrows 14) into apertures in the combination tape 13 (FIG. 2*a*) the system will be free to be unlocked. If the entered combination (a certain pattern of depressed and non-depressed fingers or keys) is a complement of the apertures in the tape 13, the system may be unlocked, and the tape 13 is advanced adjacent the finger tips 12, to a new reference combination.

The object of the present invention seeks to prevent the unlocking of the system, if two set conditions apply, viz., (a) all the keys or fingers are depressed, or (b) all the keys or fingers are in a non-depressed condition.

Apparatus has been provided to lock gate 15 against inward movement (arrow 20; FIG. 1), if either of the aforementioned conditions exist. The inward movement of gate 15 is necessary to unlock the system. Therefore, by preventing the movement of gate 15, the undesirable finger conditions will never provide a release.

The gate 15 of the invention is provided with an extension 16, which is restrained by either of two jaws 17 and 18, respectively. These jaws are integral extensions of two laterally disposed locking bails 17' and 18', respectively. These locking bails are spring loaded about shaft 19 such that they tend to bite inwardly (arrows 21) upon the finger extensions 22.

OPERATION OF THE INVENTION

The operation of the invention improvement will be explained with further reference to FIGS. 2*b* and 2*c*.

As aforementioned, fingers 10 move between a depressed and a non-depressed position in order to set the reference combination into the system. Fingers 10 pivot about shaft 23, allowing the extension 22 to move against either of the locking bail members 17' or 18', respectively. In the non-depressed condition, all the fingers 10 will press against bail member 18' as shown in FIG. 2*a*. In the depressed condition, all the fingers 10 will move against bail member 17', as shown in FIG. 2*b*.

In FIG. 2*a*, all of the non-depressed fingers 10 move against bail member 18' which in turn will move the integral jaw 18 downwardly as depicted by arrow 25. This will result in freeing the gate extension 16 from jaw 18. However, the extension 16 will still be held from movement by jaw 17, since jaw 17 will also move downwardly with jaw 18 due to the inward biasing of the bails (arrows 21).

Figure 2B:
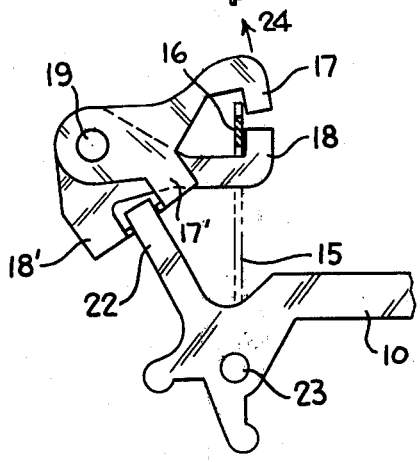
Figure 2C:
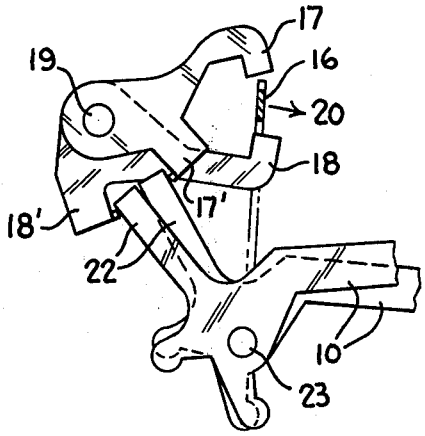

In FIG. 2*b*, all of the depressed fingers 10 press against bail member 17', which in turn will cause integral jaw member 17 to move upwardly as illustrated by arrow 24. This will result in freeing extension 16 from jaw 17. However, the extension 16 will still be held by jaw 18, since jaw 18 will also move upwardly with jaws 17 due to the inward biasing (arrows 21) of the bails.

Therefore, when all the fingers are either in the depressed or non-depressed positions, gate 15 will not be free to move, and consequently, gate 15 will not be able to move inwardly (arrow 20; FIG. 1) to unlock the system.

Only when at least one finger of the set is in the depressed position and at least one finger of the set is in the non-depressed position, will both jaws 17 and 18 be in a parted or spread position to free extension 16. This open condition is shown in FIG. 2*c*, and is indicative of the condition of having a reference combination set into the system. In other words, only when some of the fingers are depressed, and some of the fingers are not depressed to set a reference combination, will the jaws 17 and 18 be in a free position.

Of course, it will be understood that the correct entered combination will also be a required condition for allowing gate 15 to move inwardly (arrow 20; FIG. 2*c*). The freeing of the jaws 17 and 18 are restrictive only of the extreme finger positions mentioned above, which is indicative of having a reference combination set into the system.

It will also be evident that only one select finger set 10 of both finger sets 10 and 10*a* need be controlled by the locking bail members 17' and 18'. In other words, only one pair of bail members 17' and 18' is required for one select finger set (either set 10 or 10*a*, as the case may be) for operation of the inventive purpose. Controlling both finger sets 10 and 10*a* by a set of bail members would only provide redundancy.

Having thus described the invention, it is to be understood that other means other than locking bails 17' and 18' may be provided to control the finger set 10.

The particular mechanical means to control the key set is deemed to be merely exemplary for purposes of explaining the inventive intent.

What is claimed is:

1. A combination locking system of the type having a tape containing a plurality of predetermined reference combination serially disposed thereon, said tape being advanced to a new reference combination position for each unlocking operation performed upon said system, a new combination position for each unlocking operation performed upon said system, a new combination being entered into said locking system for each unlocking operation, which newly entered combination being required to complement a new predetermined reference combination which has been advanced upon said tape in order to unlock a lock of said locking system, the combination locking system comprising:

depressible fingers for setting a reference combination into said system, said fingers being movable from a first, non-depressed position to a second, depressed position, said fingers each having an extension member; and a locking bail, said locking bail having spring loaded jaw members that are engageable with said extension members of said fingers, said locking bail being movable between locking positions and a non-locking position in response to the positioning of said extension members of said fingers, said locking bail being in a locking position when all of the fingers are in the first, non-depressed position, and also when all of the fingers are in the second, depressed position, said locking bail being in a non-locking position when said extension members of said fingers are in intermixed positions corresponding to having at least one but not all of the fingers in the second, depressed position.

2. The combination locking system of claim 1, wherein all the extension members engage with the first jaw member when the fingers are all in the first, non-depressed position, and alternately engage with the second jaw member when the fingers are all in the second, depressed position, said extension members alternately engaging with the first and second jaw members respectively, when the fingers are in corresponding intermixed positions.

3. The combination locking system of claim 1, further comprising a movable gate that is restrained from movement by said locking bail when said locking bail is in a locking position, and is free to move when said locking bail is in a non-locking position.

4. A combination locking system of the type having a tape containing a plurality of predetermined reference combinations serially disposed thereon, said tape being advanced to a new reference combination position for each unlocking operation performed upon said system, a new combination being entered into said locking system for each unlocking operation, which newly entered combination being required to complement a new predetermined reference combination which has been advanced upon said tape in order to unlock a lock of said locking system, the combination locking system comprising:

depressible fingers for setting a reference combination into said system, said fingers being movable from a first, non-depressed position to a second, depressed position, said fingers each having an extension member; and a locking means, said locking means having first and second spring loaded jaw members engageable with said extension members of said fingers said locking means being movable between locking positions and a non-locking position in response to the positioning of said extension members of said fingers, said locking means being in a locking position when all of the fingers are in the first, non-depressed position, and also when all of the fingers are in the second, depressed position, said locking means being in a non-locking position when said extension members of said fingers are in intermixed positions corresponding to having at least one but not all of the fingers in the second, depressed position.

5. The combination locking system of claim 4, wherein all the extension members engage with the first jaw member when the fingers are all in the first, non-depressed position, and alternately engage with the second jaw member when the fingers are all in the second, depressed position, said extension members alternately engaging with the first and second jaw members respectively, when the fingers are in corresponding intermixed positions.

6. The combination locking system of claim 4, further comprising a movable gate that is restrained from movement by said locking means when said locking means is in a locking position, and is free to move when said locking means is in a non-locking position.

* * * * *